United States Patent [19]

Nicholson

[11] 4,164,911

[45] Aug. 21, 1979

[54] APPARATUS FOR RE-INKING PRINTING RIBBONS

[75] Inventor: Albert N. Nicholson, Santa Clara, Calif.

[73] Assignee: Engineering Systems Corporation, Santa Clara, Calif.

[21] Appl. No.: 834,405

[22] Filed: Sep. 19, 1977

[51] Int. Cl.[2] ..... B05C 1/08

[52] U.S. Cl. ..... 118/670; 118/712; 118/235; 242/73

[58] Field of Search ..... 118/6, 9, 235; 197/171, 197/161, 165; 226/11, 20, 45; 250/227, 572; 242/73, 71.9, 68.4; 400/219, 219.1, 219.3

[56] References Cited

U.S. PATENT DOCUMENTS

| | | | |
|---|---|---|---|
| 2,983,461 | 5/1961 | Kray et al. | 242/73 X |
| 3,188,478 | 6/1965 | Binks | 250/572 |
| 3,232,547 | 2/1966 | Thiede et al. | 226/20 X |
| 3,383,234 | 5/1968 | Nikkel | 118/262 X |
| 3,520,276 | 7/1970 | Martin | 118/262 X |
| 3,663,083 | 5/1972 | Friedman et al. | 250/227 X |
| 3,735,733 | 5/1973 | Henc | 118/262 X |
| 3,885,518 | 5/1975 | Varni | 118/235 X |
| 4,000,804 | 1/1977 | Zaltieri | 197/161 |
| 4,021,031 | 5/1977 | Meihofer et al. | 226/20 |
| 4,048,952 | 9/1977 | Peterson et al. | 118/6 |

*Primary Examiner*—John P. McIntosh

[57] ABSTRACT

A machine for re-inking printing ribbons for line printers and the like includes a pair of spaced apart spool mechanisms which receive the supply and take-up spools of the ribbon. Disposed between the spool mechanisms is an inking roller which is partially submerged in an ink tank. Adjacent to the tank is a light source and light pipe assembly for detecting holes in the ribbon to be inked. The device accommodates ribbon spools of differing lengths, and is also provided with a ribbon edge sensor which controls the axial position of the ribbon as it is wound onto one of the spools. The spool mechanisms drive the ribbon past the hole detector in one pass, and a pressure roller urges the ribbon onto the inking roller in another pass to re-ink the ribbon.

3 Claims, 16 Drawing Figures

APPARATUS FOR RE-INKING PRINTING RIBBONS

BACKGROUND OF THE INVENTION

High speed computers have gained wide acceptance, not only as research tools, but also for process and inventory control in industry, and for data storage and decision making purposes in business. The most common form of output device used in conjunction with these computers is the high speed line printer.

A high speed line printer may operate at a rate in excess of one thousand one hundred (1100) lines per minute, and typically employs selected indicia producing characters which strike an inked ribbon which is disposed adjacent to the paper to be printed. The inked ribbon may be on the order of 14 to 17 inches in width, and is typically fabricated from nylon cloth, silk, or the like. Such ribbons often provide between five and six million lines of printing before the ink contained therein is depleted to the point where the printed indicia is not a dense black.

It may be appreciated that in a machine operating at eleven hundred lines per minute, the inked ribbon may become depleted in a relatively short time. Many computer facilities, in which a plurality of line printers are operating, use ten to twenty ribbons daily in normal operation. These ribbons, typically, cost in excess of $20.00 each. After the ink is depleted, the ribbon is typically thrown away. Thus, the cost of new printing ribbons may comprise a substantial portion of the overhead of a line printer.

The prior art discloses machines for re-inking printing ribbons, in the assumption that it is less expensive to re-ink a used ribbon than to purchase a new one. The following U.S. Pat. Nos. comprise the most pertinent prior art: 3,731,649, 3,885,518.

In re-inking a printer ribbon, it is important to minimize the handling of the ribbon in order that labor costs may be minimized. Thus, the re-inking machine must be as automatic as possible. More importantly, the used ribbon must be scanned to determine the integrity of the fabric web, and to detect any holes therein which might cause a misprint, or lack of print, in a portion of the line printer output.

In both of these respects, the performance of prior art printer ribbon re-inking machines has been poor.

SUMMARY OF THE PRESENT INVENTION

The present invention generally comprises a machine which is adapted both to scan a printer ribbon to search for any defects therein, and to re-ink the ribbon for subsequent re-use. The device is automatic, so that little labor is involved in its use, and it may easily accommodate printer ribbons and spools of various widths.

The machine includes a generally rectangular, box-like frame which supports a pair of spool mechanisms in parallel, spaced apart relationship. Each spool mechanism is provided with a controlled motor for driving a spool supported on hubs associated therewith, one of the hubs being secured to an extendible shaft which is spring loaded to engage the ribbon spool. Disposed intermediate of the spool mechanisms is an ink tank in which an inking roller is partially immersed. The inking roller is situated so that the printer ribbon, in passing from one spool mechanism to the other, may impinge on the inking roller and receive a fresh supply of ink therefrom.

Hingeably secured to one edge of the frame of the machine is an upper frame portion, which supports a pressure roller which is aligned with the inking roller. The pressure roller is adapted to selectively impinge on the printer ribbon and urge it into contact with the inking roller, so that the re-inking process may take place. The upper frame portion also includes a linear light source extending parallel to the pressure roller and across the width of the printer ribbon.

Secured in the lower frame directly below the light source is a light collector, which comprises a transparent planar member having reflective sides and a lower edge provided with an upwardly facing parabolic configuration. A pair of light sensors are disposed in a notch at the focus of the parabola, so that any light received by the upper edge of the light collector will be reflected to the light sensors and thereby detected. The printer ribbon passes between the light source and the light collector, so that the light sensors generally receive no illumination. Only a hole in the printer ribbon of significant size will provide sufficient illumination to cause a light sensor signal and actuate a hole detector circuit.

The machine also includes a printer ribbon edge sensing system which guides the printer ribbon as it is taken up on one of the spools. The edge sensing system includes a light source and a pair of photosensors which are disposed adjacent to the vertical plane in which the edge of the printer ribbon is to be wrapped onto the spool. The photosensors drive a servo-system which causes the hubs of the spool mechanism to translate axially while the printer ribbon is being unwound from the spool. Thus, a misaligned printer ribbon may be rewound in an orderly, unskewed fashion.

The invention also includes a state sequencer which automatically controls the operation of the spool mechanisms, the actuation of the pressure roller, the edge guide system, and the ink supply. The state sequencer is programmed so that the operation of the machine is generally automatic, and the labor required of the machine operator is minimal.

A BRIEF DESCRIPTION OF THE DRAWING

DESCRIPTION OF THE PREFERRED EMBODIMENT

Figure 1:
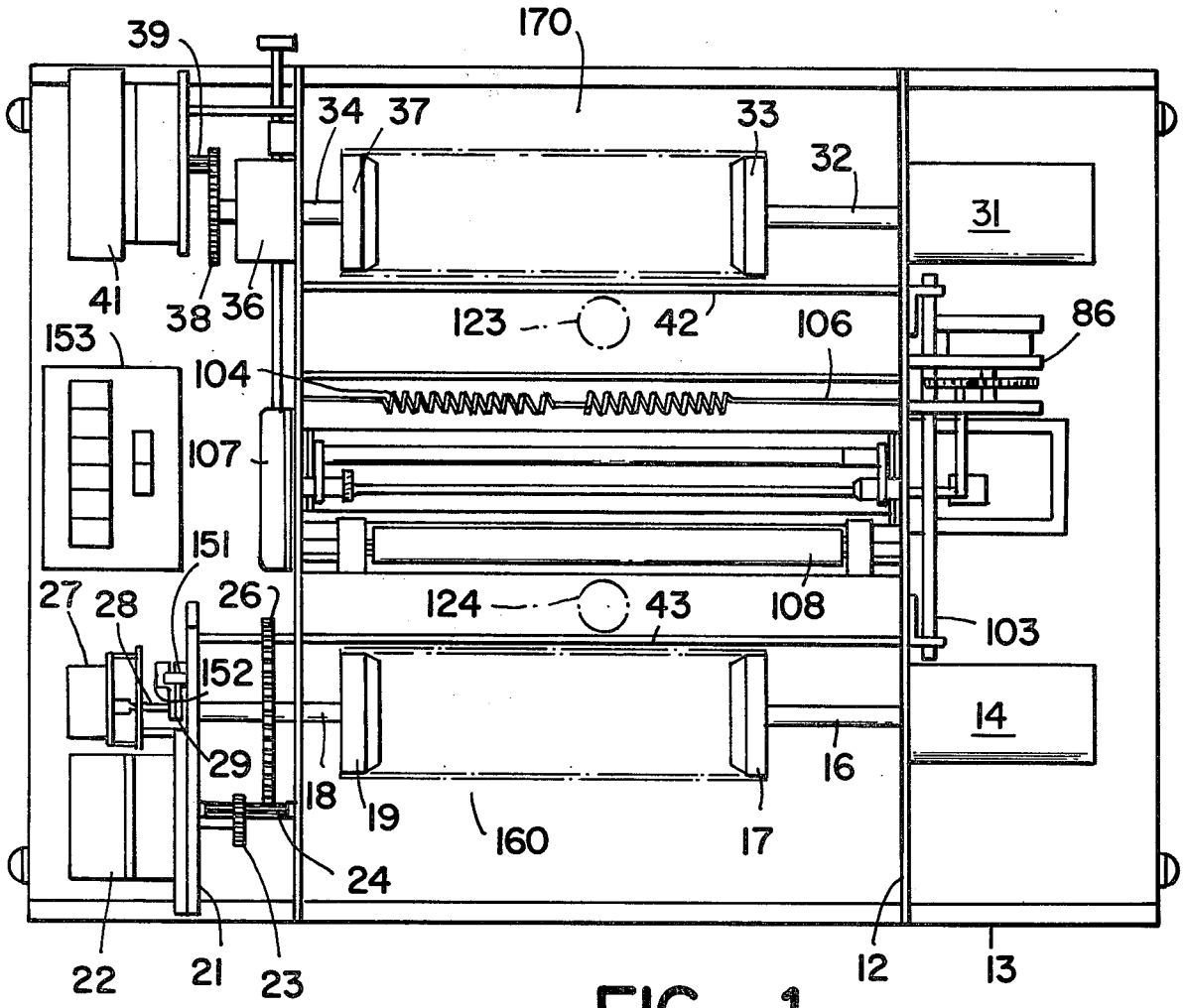
FIG. 1 is a plan view of the printer ribbon re-inking machine of the present invention.
Figure 2:
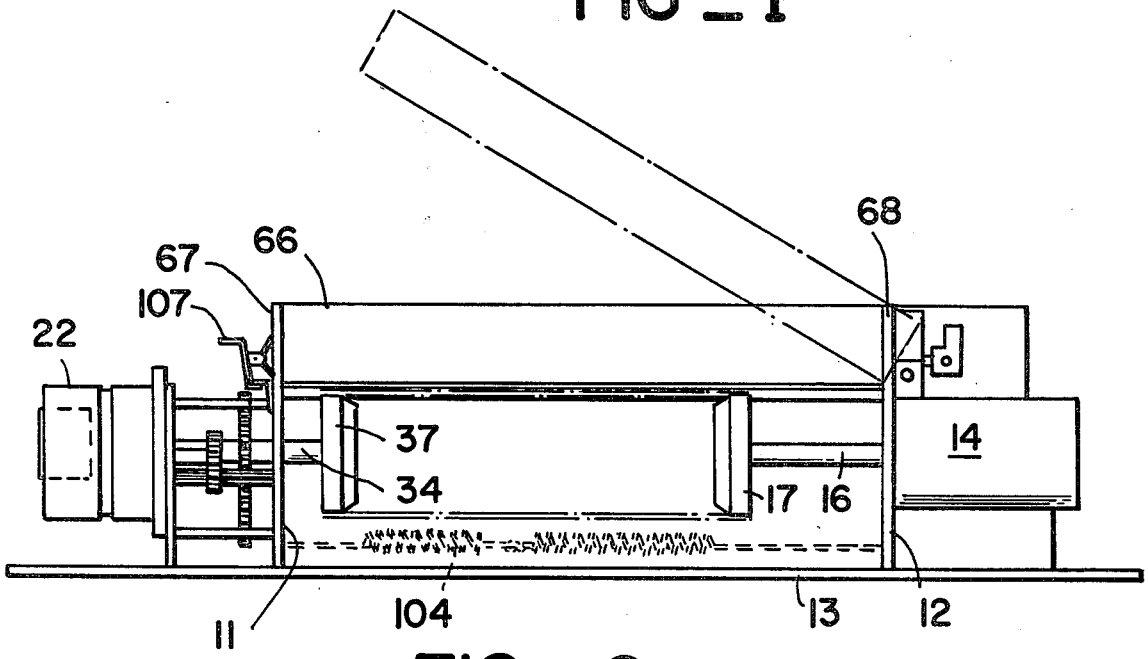
FIG. 2 is a front elevation of the printer ribbon inking machine of the present invention.

As shown in FIGS. 1 and 2, the printer ribbon reinking machine of the present invention includes a front panel 11 and a rear panel 12 disposed in parallel, spaced apart relationship. These panels are secured to a planar base 13, and a plurality of support rods and transverse panels extend between the panels 11 and 12 to form a rigid, box-like rectangular lower frame.

Joined to a medial end portion of the panel 12 is a cylindrical housing 14. A spool shaft 16 is rotatably supported by bearings within the housing 14, and the shaft 16 is also axially translatable within its support in the housing 14. A helical spring in the housing 14 biases the shaft 16 to extend outwardly from the housing. A spool hub 17 is secured to the distal end of the shaft 16 in a manner to be described in the following.

Joined to the front surface of the front panel 11 is an auxilliary panel 21. The panels are secured together in spaced apart, parallel relationship by means of standoffs and screws, as is known in the art. A spool shaft 18 is journalled in the panels 11 and 21 in a freely rotating and axially translatable fashion. Secured to the distal end of the shaft 18 is a spool hub 19. It may be appreciated that the shafts 16 and 18 are disposed in axial alignment. Secured to the shaft 18 is a drive gear 26.

A spool drive motor 22 is secured to the front surface of the panel 21, and the output shaft of the motor 22 is connected through gear 23 to a pinion gear 11 which extends between the panels 11 and 21. The pinion gear engages the drive gear 26, and it should be noted that the shaft 18 may be translated axially while the drive gear 26 maintains engagement with the pinion gear 24. The spool drive motor 22 will thus drive the shaft 18 and hub 19 in rotational motion with the shaft 18 disposed in any axial position within the limits defined by the drive gear 26 and the panels 11 and 21.

Also secured to the panel 21 is a spool shaft drive motor 27. The output shaft for this motor is connected directly to a screw member 28, which engages a threaded hole in a drive block 29. The drive block is secured to the proximal end of the shaft 18, to effect axial translation thereof. As the motor 27 is selectively actuated, the screw member 28 causes the drive block 29 to translate in an axial direction, carrying with it the shaft 18 and the hub 19. A printer ribbon spool is supported on the hubs 17 and 19, and the axial translation of the shaft, together with the outward spring biasing of the shaft 16, permits the spool supported on the hubs 17 and 19 to be shifted axially so that the edge of the printer ribbon may be properly aligned, as will be described in the following.

Joined to the other medial end portion of the panel 12 is a cylindrical housing 31, from which a spool shaft 32 extends. The spool shaft 32 is supported in a freely rotating and axially translating fashion within the housing 31, and a spring within the housing 31 biases the shaft 32 to extend outwardly therefrom. Joined to the distal end of the shaft 32 is a spool hub 33. Another spool shaft 34 is journalled in a freely rotating fashion within a housing 36 which is secured to the panel 11. The shaft 34 is axially aligned with the shaft 32, and a spool hub 37 is secured to the distal end of the shaft 34. It may be appreciated that the hubs 33 and 37 are disposed to support a printer ribbon spool, and are adapted for selective rotation thereof. The proximal end of the shaft 34 is joined to a drive gear 38, which engages a pinion gear 39. The pinion gear 39 extends from the output shaft of a spool drive motor 41, which is secured to the panel 11 by means of screws and stand offs. The motor 41 drives the ribbon spool supported on the hubs 33 and 37 by means of the gear train 39 and 38.

Figure 7:
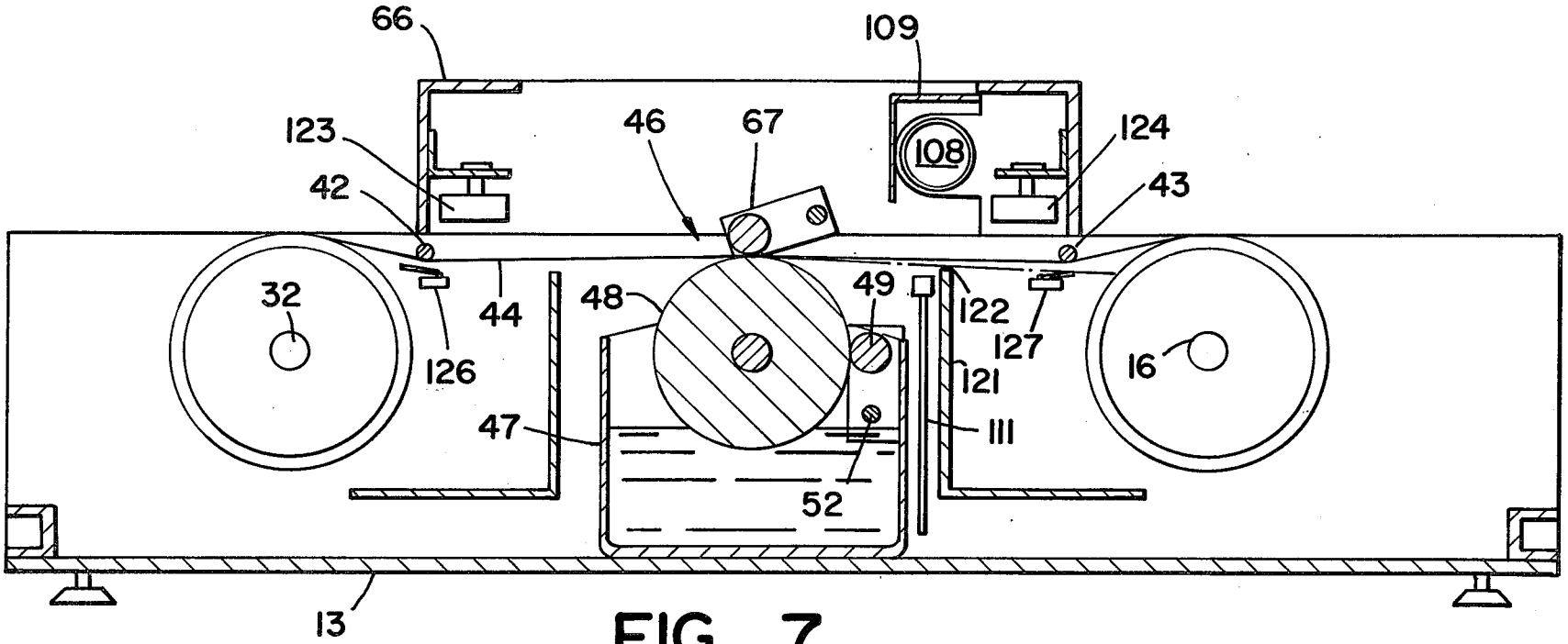
FIG. 7 is a cross-sectional elevation of the printer ribbon inking machine of the present invention.

Extending between the panels 11 and 12 and disposed adjacent to the spool mechanisms and a pair of ribbon guide rollers 42 and 43, as shown in FIGS. 1 and 7. As shown by the broken line in FIG. 7, the roller guides 42 and 43 impinge on the printer ribbon 44 to provide tension thereon, and to maintain the desired position of the ribbon as it translates from one spool to the other. Disposed medially of the two spool mechanisms is the ribbon inking assembly 46. This assembly includes a generally rectangular ink tank 47 which has a longitudinal extent parallel to the ribbon spools. Rotatably supported by the panels 11 and 12 and extending therebetween is an inking roller 48. The inking roller is disposed with the lower portion thereof within the ink tank 47, and submerged within the ink supply therein. The inking roller 48 is freely rotatable, and is not motor driven.

Figure 13:
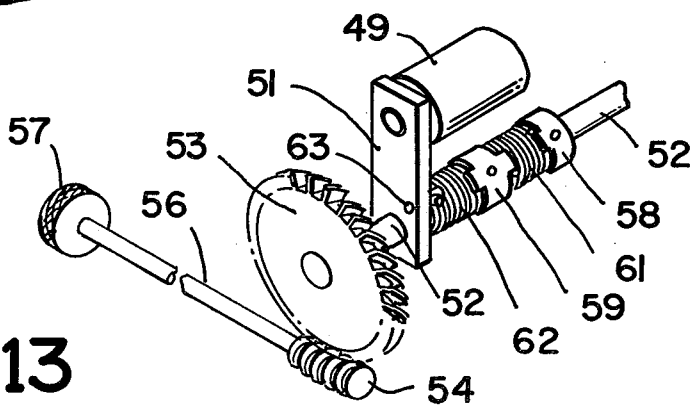
FIG. 13 is a perspective view showing the pressure adjustment mechanism of the metering roller of the inking assembly of the present invention.

The inking assembly 46 is also provided with a metering roller 49 which controls the amounts of ink carried by the inking roller from the ink bath within the tank to the printer ribbon 44. The metering roller 49 is equal in longitudinal extent to the inking roller 48, this dimension being larger than the width of any printer ribbon which may be inked. The metering roller 49 is supported at each end by a bearing secured in a support arm 51. A torque shaft 52 is disposed generally subjacently of the metering roller 49, extending between the panels 11 and 12 and being journalled therein. The torque shaft 52 extends through holes provided in the lower ends of the arms 51, in freely rotating fashion, as shown in FIG. 13. A worm gear 53 is secured to the front end of the shaft 52, and is disposed adjacent to the front surface of the panel 11. A worm 54 engages the worm gear 53, the worm 54 being secured to one end of an adjustment shaft 56. The other end of the shaft 56 is provided with a knob 57 which permits manual rotation of the shaft, the worm, the worm gear 53, and thus the shaft 52.

The shaft 52 is provided with a spring stop 58 which is fixedly secured to the shaft by means of a set screw, cotter pin, or the like. A second spring stop is secured to the shaft in freely rotating fashion, and is spaced medially between the spring stop 58 and the arm 51. A helical torsion spring is disposed between the spring stop 58 and the spring stop 59, and another helical torsion spring 62 is secured between the spring stop 59 and the arm 51. The ends of the springs 61 and 62 are torsionally secured to the adjacent spring stops, and the front end of the spring 62 is secured to a pin 63 extending from the arm 51.

It may be understood that as the shaft 56 is rotated by means of the knob 57, torque is applied to the shaft 52.

This torque is transferred in resilient fashion through the spring stops 58 and 59 and the torsional spring 61 and 62 to the arm 51. The same torsional spring assembly is provided at the other end of the shaft 52. This torsional force is applied to the roller 49 through the arms 51, causing the roller 49 to impinge on the inking roller 48 with a selectively variable force. As is known in the art, greater force urging the metering roller to impinge on the inking roller decreases the amount of ink which is carried on the surface of the inking roller. Thus the knob 57 may be employed to select the amount of ink which is provided to the ribbon 44 by the inking assembly 46.

Figure 10:
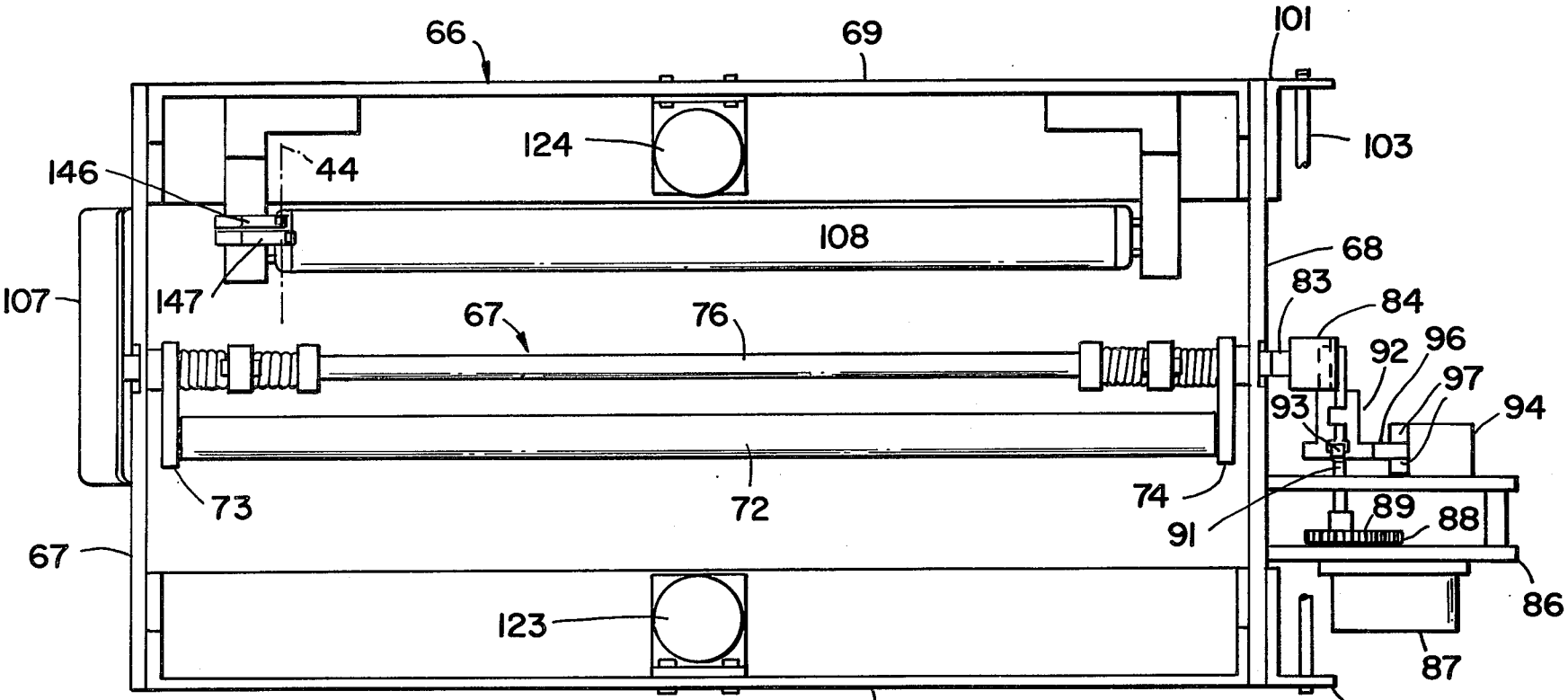
FIG. 10 is a bottom view of the upper frame portion of the machine of the present invention.

The machine of the present invention also includes an upper frame assembly 66, as shown in FIGS. 2, 7, and 10. The upper frame assembly is provided with a rectangular box-like configuration disposed superjacent to the panels 11 and 12, and having a longitudinal extent equal to the spacing of those panels. As shown in FIG. 7, the upper frame assembly 66 is disposed generally superjacent of the medial portions of the panels 11 and 12.

Secured within the upper frame assembly 66 is a pressure roller assembly 67. The pressure roller assembly is provided to urge the printer ribbon 44 into contact with the inking roller 48, so that inking of the ribbon 44 may be effected.

As shown in FIG. 10, the upper frame assembly 66 includes a pair of front and rear end panels 67 and 68, which are joined at their distal ends by a pair of longitudinally extending side panels 69 and 71. A torque shaft 76 of the pressure roller assembly 67 extends between the end panels 67 and 68, with the ends thereof journalled therein. A pair of support arms 73 and 74 are secured about the shaft 76 in freely rotating fashion. Extending between the arms 73 and 74 is a longitudinally extending pressure roller 72, which is supported by bearings secured in the arms 73 and 74.

Figure 11:
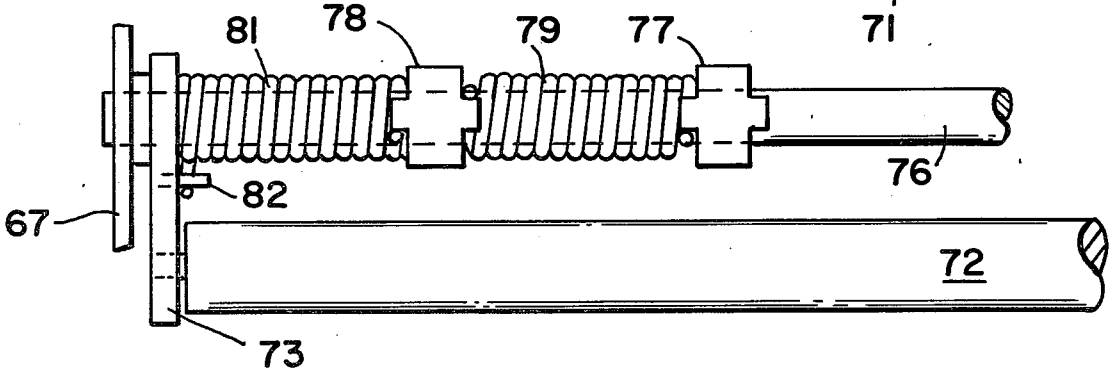
FIG. 11 is an enlarged, detailed view of a portion of the pressure roller assembly of the present invention.

As shown in FIG. 11, each end of the torque shaft 76 is provided with a pair of spring stops 77 and 78 disposed in spaced relationship from the corresponding support arm. The pair of helical torsion springs 79 and 81 are disposed between the spring stops 77 and 78, and the respective support arm. The spring stops 77 are fixedly secured to the shaft 76, while the spring stops 78 and the springs themselves are freely rotatable about the shaft 76. The ends of the springs 81 which are disposed adjacent to their respective support arms engage a pin 82 extending therefrom to impart torque to the respective support arm.

The pressure roller assembly functions in a manner similar to the metering roller assembly depicted in FIG. 13, and described in the foregoing. That is, torque which is imparted to the shaft 76 is resiliently coupled to the spring stops 77 and 78 and the torsional springs 79 and 81 to the support arms 73 and 74. This torsional force urges the pressure roller 72 to impinge on the ribbon 44, as shown in FIG. 7, and cause it to engage the inking roller 48.

Torque is imparted to the shaft 76 by means of a selectively controlled motor 87 which is secured to a bracket 86. A pinion gear 88 is secured to the output shaft for the motor 87, and it engages a drive gear 89 which is secured to a shaft journalled in the bracket 86. A screw member 91 extends axially from the shaft, as shown in FIG. 10, and is threadedly engaged by a nut 93. As the screw member rotates, the nut 93 is driven to translate axially with respect to the screw member 91.

A linking member 92 is secured to radial holes in the nut 93, and is caused to translate therewith. A block 84 is secured to the end 83 of the shaft 76, which extends through the panel 68. A lever extends radially from the block 84, and it is pivotally secured to the linking member 92.

It may be appreciated that as the motor 87 rotates the screw member 91 through the gear train 88 and 89, the nut 93 and the linkage 92 translate in an axial direction. The lever extending from the block 84 is also translated by the linking member 92, imparting a torsional force to the shaft 76. Thus, the motor 87 causes the pressure roller 72 to engage the printer ribbon with the inking roller.

Also secured to the bracket 86 is a photosensor module 94. The module 94 includes a pair of light sensors 97, each of which projects a light beam across a narrow gap to a photo pickup. The gaps of the sensors 97 are in planar alignment, and an arm 96 extends from the linking member 92 in that plane. As the linking member 92 is driven to translate, in the course of loading or unloading the pressure roller upon the inking roller, the arm 96 interrupts one of the sensors 97 at the desired pressure roller loaded or unloaded position. The signals from the sensors 97 are employed to control the motor 87, as will be explained in the following. The upper frame assembly 66 is pivotally secured to the lower frame assembly by means of a pair of brackets 101 and 102 which extend from the panel 68 of the upper frame assembly. The brackets 101 and 102 support a hinge pin 103, and a similar pair of brackets extend from the lower frame assembly and are also pivotally secured to the hinge pin 103. The upper frame assembly is thus free to pivot about the axis of the pin 103.

The moment of the upper frame assembly about the hinge pin 103 is counterbalanced by an extension spring assembly 104. One end of the extension spring assembly 104 is secured to a lower medial portion of the panel 11, and the other end is secured to a flexible cable 106. The cable passes around a pulley wheel (not shown) which is supported on the rear surface of the panel 12, and is secured to the rear edge portion of the bracket 86. A latch mechanism 107 is secured to the front surface of the panel 67 above the upper frame assembly, and it engages a strike extending from the panel 11 to maintain the upper frame assembly secured to the lower frame assembly. When the latch is released, the spring tension of the assembly 104 acting on the bracket 86 causes the upper frame assembly to pivot upwardly, as shown in phantom line in FIG. 2.

A salient feature of the present invention is a hole detector assembly which detects any holes in the printer ribbon 44 which are of sufficient size to cause a misprint or lack of print when the ribbon is in use in a line printer. As shown in FIGS. 1 and 7, the hole detector assembly includes a fluorescent lamp 108 which is secured in the upper frame assembly with its longitudinal axis extending the width of the printer ribbon. The lamp 108 is provided with a deflector 109 which directs the illumination from the lamp downwardly toward the printer ribbon.

Figure 8:
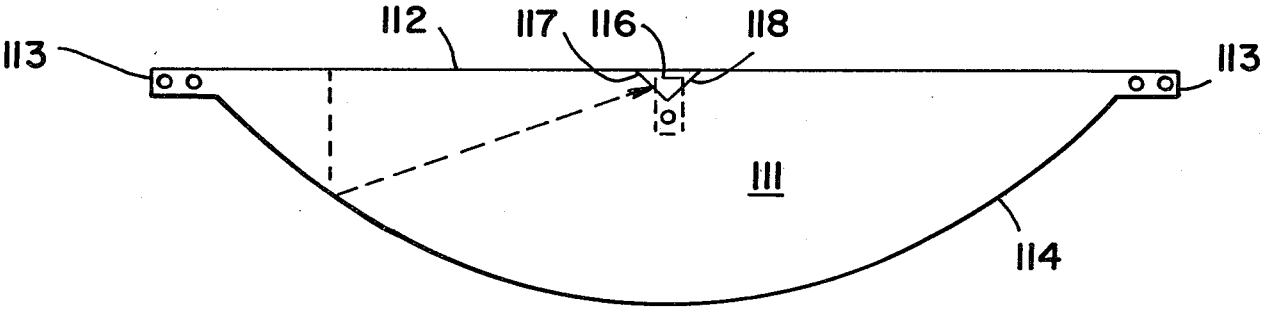
FIG. 8 is a side view of the light collector portion of the hole detector apparatus of the present invention.
Figure 9:
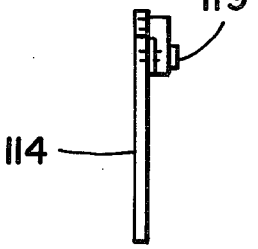
FIG. 9 is an end view of the light collector portion of the present invention, as shown in FIG. 8.

Disposed directly subjacently of the lamp 108 and oriented parallel thereto is a light collector 111. The light collector 111 is a planar member which is disposed adjacent to the ink tank 47 in the lower frame assembly, and is supported thereby. As shown in FIG. 8, the light collector includes a linear upper edge 112 which is directed toward the lamp 108. A pair of mounting ears 113 extend from the opposite ends of the edge 112. The lower edge 114 of the light collector is provided with a parabolic configuration which has a focus disposed at the medial portion of the edge 112.

The light collector is formed of a highly transparent material, such as acrylic plastic or the like, and all of the surfaces except the upper edge 112 are plated with an aluminum coating to form an internally reflecting surface. It may be appreciated that light may enter the light collector only through the top edge 112, and that all light will be reflected internally from the side walls and the parabolic bottom edge to the focus of the parabola.

Disposed at the focus of the parabolic edge 114 is a V-shaped notch 116. A pair of light sensors 117 and 118 are secured to the sides of the V-shaped notch by means of a bracket 119 which is secured to the side of the light collector. The V-shaped notch is provided so that the light sensors 117 and 118 are disposed at an angle less than the critical angle of the material of the light collector. Thus, any light reflected from the distal portions of the parabolic edge 114, as shown the phantom line in FIG. 8, will strike the edge of the V-shaped notch at an angle less than the critical angle and will pass through to the light sensor. It should be noted that the light sensors 117 and 118 comprise thin, planar, elongated members which impinge directly on the sides of the notch 116, the light sensors being sensitive on both their upper and lower surfaces.

With reference to FIG. 7, it may be seen that the illumination provided by the lamp 108 is blocked by the printer ribbon 44 which is disposed between the lamp and the light collector 111. Thus, no illumination is received by the light collector 111, and there is no output from the sensors 117 and 118. However, should a hole in the ribbon 44 pass by the light collector 111 during the transfer of the ribbon from one spool mechanism to the other, light from the lamp 108 will be admitted to the light collector 111, and a signal will be generated by at least one of the light sensors. This signal is used to control the operation of the machine, as will be described in the following.

As shown in FIG. 7, a transverse panel 121 is disposed adjacent and parallel to the light collector 111, and is secured at either end to the frame panels 11 and 12. Secured to the upper edge of the transverse panel 121 is a longitudinally extending cleaning knife 122. The edge of the cleaning knife 122 extends across the width of the printer ribbon 44, as it passes by from one spool mechanism to the other, and the sharp edge of the knife removes dirt, lint, and debris adhering to the side of the ribbon which is to be inked. The cleaning knife 122 thus cleans the inking surface of the ribbon to provide a uniform distribution of ink thereon.

The present invention also includes a system for sensing the end of the printer ribbon as the ribbon translates from one spool mechanism to the other. As shown in FIG. 7, a pair of sensing bobbins 123 and 124 are secured to the upper frame assembly with the sensing axes thereof directed downwardly toward the printer ribbon 44. Each sensing bobbin includes an electromagnetic coil which is energized with alternating current to radiate a magnetic field downwardly toward the printer ribbon. As is well known in the art, the printer ribbons are often provided with an end of ribbon indicator which comprises either a strip of metal foil extending the width of the ribbon, or a thin metal rod also extending the width of the ribbon.

As the end of ribbon indicator passes either of the bobbins 123 or 124, it will enter the alternating magnetic field emanating therefrom. The alternating magnetic field will set up eddy currents in the end of ribbon indicators, and the eddy currents will in turn create an alternating magnetic field which opposes the field emenating from the bobbin. The result is that the sensor bobbin experiences a change in induction, and this change may easily be sensed by an end of ribbon indicator circuit, which is not shown. The signal from the sensor bobbins is thus used to control the operation of the spool mechanisms, as will be detailed in the following.

To accommodate those printer ribbons which do not incorporate and end of ribbon indicator, the present invention is provided with a pair of mechanical switches 126 and 127 to indicate whenever a spool has been completely unwound on one of the spool mechanisms. The switches 126 and 127 are disposed generally subject to the roller guides 42 and 43, and are secured to the main frame assembly. Each of the switches 126 and 127 includes a feeler arm which extends from the switch toward the spool on the spool mechanism. The feeler arm is disposed directly subjacently of the printer ribbon 44 as it unwinds from the top of the spool.

As is known in the art, the end of the printer ribbon is secured to its spool by means of staples, adhesive, or the like. As the ribbon unwinds to the very end, the ribbon no longer unwinds tangentially from the spool. Rather, the very end portion of the ribbon is carried in an arcuate path by the spindle, causing it to impinge on the feeler arm of the switch; for example, as shown by the phantom line impinging on the switch 127 in FIG. 7. The switch is thus actuated, and the signal from the switch is used to control the spool mechanisms of the present invention.

Another salient feature of the present invention is the provision of spool hubs for the spool mechanisms which can accommodate the two different models of printer ribbon spools, each having the same diameter but differing lengths, which are known and commonly used in the art. As shown in FIGS. 3 through 6, a typical printer ribbon spool 128 is provided with four slots 129 disposed in the end of the hollow tubular body thereof. The hub of the present invention includes a cylindrical body portion 131 having a diameter slightly larger than the outside diameter of the spool 128. Extending axially and concentrically from the body portion 131 is a shoulder 132 which also has a cylindrical periphery. The diameter of the shoulder 132 is substantially equal to the inner diameter of the spool 128.

Joined axially and concentrically to the shoulder 132 is a conical end portion 133 which is truncated by the end surface 134 extending perpendicular to the axis of the hub. The diameter of the end surface 134 is smaller than the inner diameter of the spool 128, and it may be appreciated that the tapering surface of the conical portion 133 will permit the spool 128 to be easily centered on the hub, so that the shoulder portion 132 may engage the inner bore of the spool.

Extending radially outwardly from the shoulder 132 are a pair of pins 136 which are press fit into holes 137. The outward extent of the pins 136 is substantially equal to the diameter of the body portion 131 of the hub. The diameter of the pins 136 is slightly smaller than the width of the slots 129, and the pins engage the slots to provide a torque coupling between the hub and the spool.

Extending axially through the hub from the end surface 134 to the end surface 138 is a cylindrical hole 139. The diameter of the hole 139 is slightly larger than the outside diameter of the spool shaft 16 or 32, so that the shaft may be slidably received therein. Extending radially outwardly from the hole 139 is a pair of diametrically opposed slots 141, which extend the length of the hole 139. Disposed in the end surface 138 of the hub is a diametrically extending groove 142. The diametrical axes of the groove 142 and the slots 141 are perpendicular.

Figure 3:
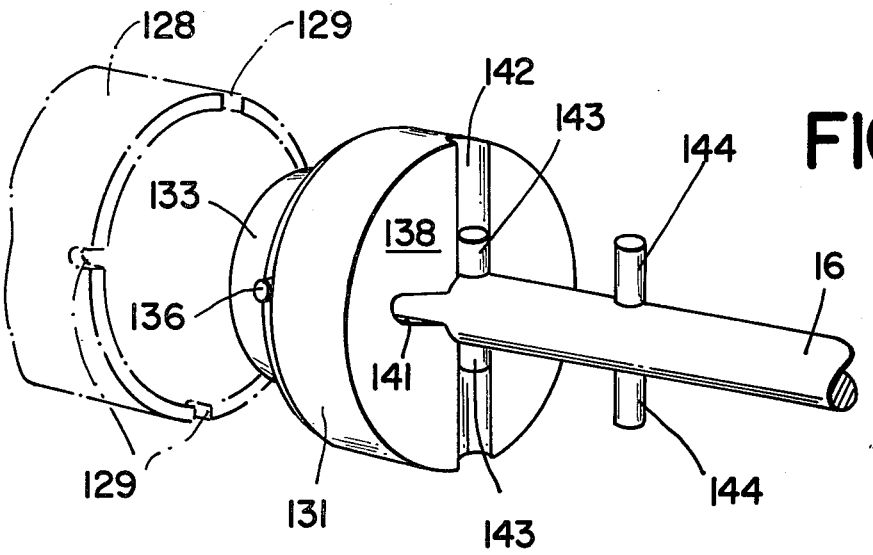
FIG. 3 is a perspective view of the novel spool hub feature of the present invention.
Figure 4:
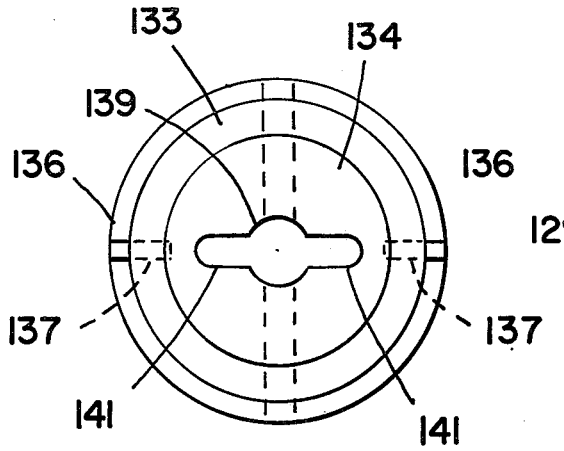
FIG. 4 is a plan view of the spool hub feature shown in FIG. 3.
Figure 5:
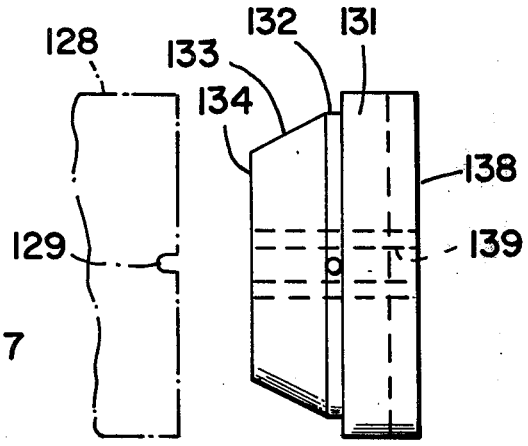
FIG. 5 is a side view of the spool hub feature of the present invention as shown in FIGS. 3 and 4.
Figure 6:
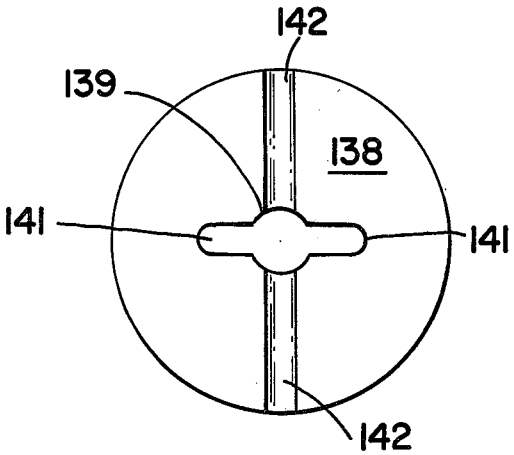
FIG. 6 is an end view of the spool hub of the present invention.

The spool shaft adapted for engaging the hub of the present invention, as for example the shaft 16 shown in FIG. 3, includes a pair of hub engaging pins 143 extending diametrically outwardly therefrom near the distal end of the shaft. The distal extent of the pins 143 is less than the diametrical extent of the slots 141, and the diameter of the pins 143 is less than the width of the slot 141. Furthermore, the diameter of the pins 143 is slightly less than the width of the groove 142. Thus the pins 143 may be slidably received through the slots 141, or they may be received in a groove 142 in a torque translating engagement.

A second pair of diametrically opposed hub engaging pins 144 are secured to the shaft 16 in axially spaced relationship to the pins 143. The pins 144 are the same diameter as pins 143, but are slightly longer so that their distal extent is greater than that of the slots 141. Thus the pins 144 act as a stop for the hub on the shaft 16. The pins 144 are also capable of engaging the groove 142 in a torque transmitting engagement. The axial spacing of the pins 143 and 144 is equal to the difference in the lengths of the two standard printer ribbon spools commonly employed in the industry.

When the machine of the present invention is to be employed to ink a printer ribbon which is secured on the shorter of the two standard spools, the hub is secured to the shaft 16 by first sliding the end of the shaft into the cylindrical hole 139 with the groove 142 aligned with the pins 143. This is shown in FIG. 3. The pins 143 engage groove 142 in a torque transmitting fashion, and also act as a stop to prevent any axial translation of the hub on the shaft 16. Due to the fact that the shaft 16 is spring biased toward the spool 128, the engagement of the pins 143 in the groove 142 is maintained. Furthermore, the spring bias feature of the shaft 16 maintains the engagement of the pins 136 in the slots 129 of the spool 128.

To accommodate the longer of the standard ribbon spools, the hub is slid farther onto the shaft 16. This is accomplished by first aligning the slots 141 with the pins 142, so that the pins may pass therethrough as the spindle is slided onto the shaft 16. After the hub has cleared the pins 143, the hub is rotated so that the groove 142 is aligned with the pins 144. The pins 144 act as a stop for the hub, and also engage the groove 142 in a torque transmitting fashion. It should be noted that the width of the hub, as measured from the end surfaces 134 to 138, is less than the spacing of the pins 143 from the pins 144. Thus when the hub is engaging the pins 144, the pins 143 are spaced distally from the end surface 134.

It should be noted that the hub of the present invention may easily be adjusted to accommodate the ribbon spools of differing lengths, while providing a positive support of the spool and transmission of torque thereto.

Figure 12:
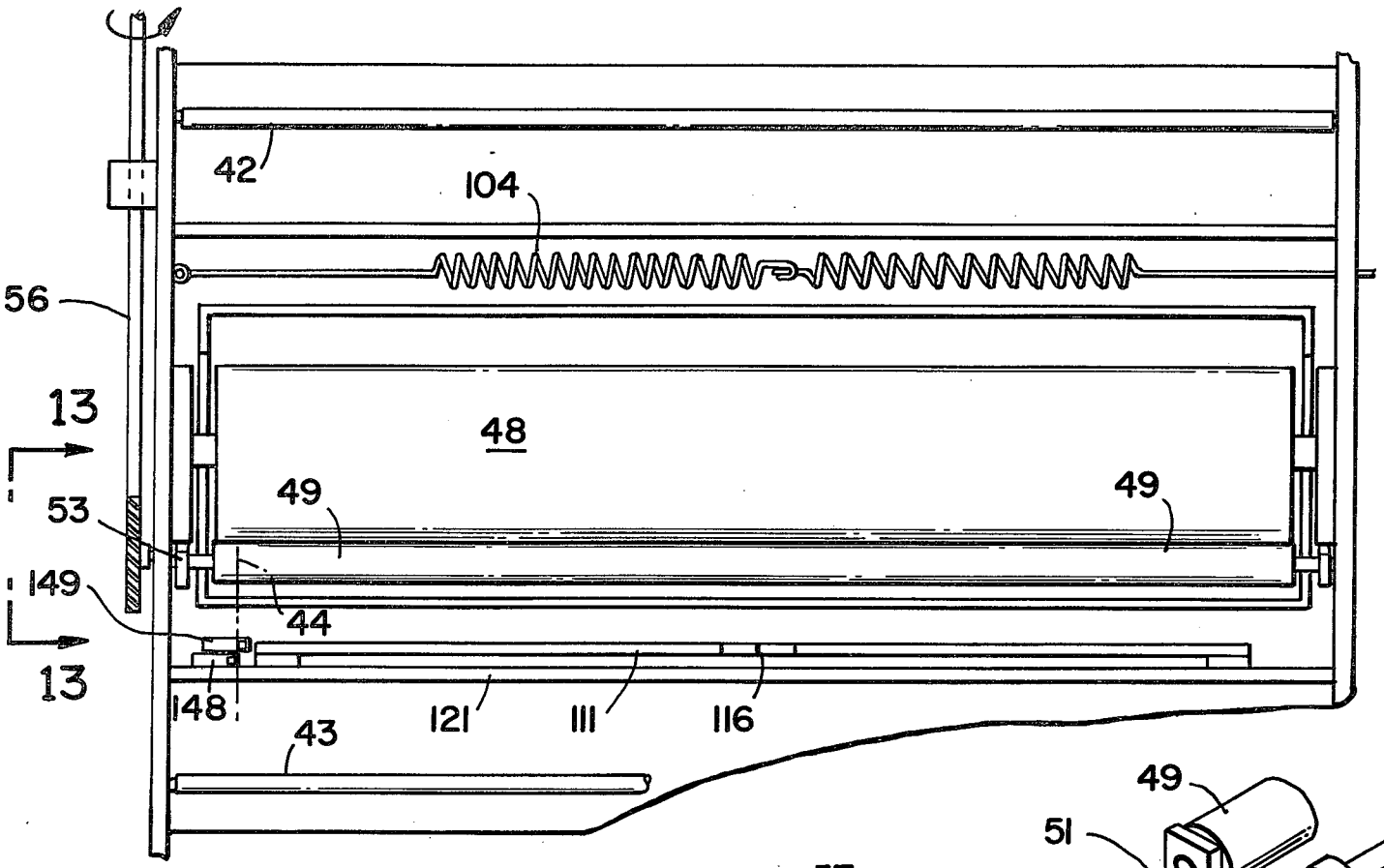
FIG. 12 is a top view of the upper frame assembly of the machine of the present invention.

Another important feature of the present invention is a photoelectric ribbon edge detector assembly. As shown in FIGS. 10 and 12, this assembly includes a pair of photoelectric detectors 146 and 147 secured to a portion of the upper frame assembly 66 directly subjacently to one of the brackets supporting the lamp 108. The detectors 146 and 147 are slightly offset longitudinally, so that their sensing apertures may straddle the plane in which the edge of the printer ribbon is to be disposed, as shown by the broken line in FIG. 10. Secured to the transverse panel 121 of the lower frame assembly, and disposed directly subjacently of the sensors 146 and 147, are a pair of light sources 148 and 149, as shown in FIG. 12. It should be noted that the light sources are longitudinally staggered in exact correspondence to the light sensors, and are disposed at one end of the light collector 111. As the edge of the ribbon 44 passes between the light sensors and their corresponding light sources, one or the other of the sensors will be blocked or actuated as the ribbon edge wanders as the ribbon is being unwound from one spool mechanism and wound onto the other one. The changing signals from the light sensors 146 and 147 are employed by the control logic of the present invention to control the motor 27, which in turn selectively controls the axial position of the hubs 17 and 19. Thus the photoelectric edge sensing signals are used to rectify the wrap of a printer ribbon which may have been poorly wrapped while being used in a line printer.

The present invention also includes a spool axial position sensor which operates in conjunction with the right hand spool mechanism 160, as shown in FIG. 1. The spool axial position sensor includes a planar arm 152 which extends from the block 29 of the axial drive mechanism associated with the shaft 18. Secured to the panel 21 is a pair of photoelectric sensors which are substantially the same in nature and construction as the sensors 97 which are associated with the pressure roller motor assembly shown in FIG. 10. That is, as the arm 152 is translated by motion of the block 29, the paired sensors 151 are either actuated or blocked by the arm. Due to the fact that the block 29 is secured directly to the end of the shaft 18, the signals from the sensors 151 provide a direct indication of the axial position of the shaft 18 and thus of the hub 19 and the edge of the ribbon 44. The signals from the sensors 151 are conducted to the control logic of the present invention for the purpose of controlling the motor 27 during part of the inking procedure.

As shown in FIG. 1, the machine of the present invention is provided with a control panel 153, which includes manual pushbuttons and indicator lights to control the operation of the machine and to apprise the operator of the functioning of the machine. Disposed directly below the control panel 153 are a plurality of logic boards, not shown, which embody the control logic of the machine.

Figure 14:
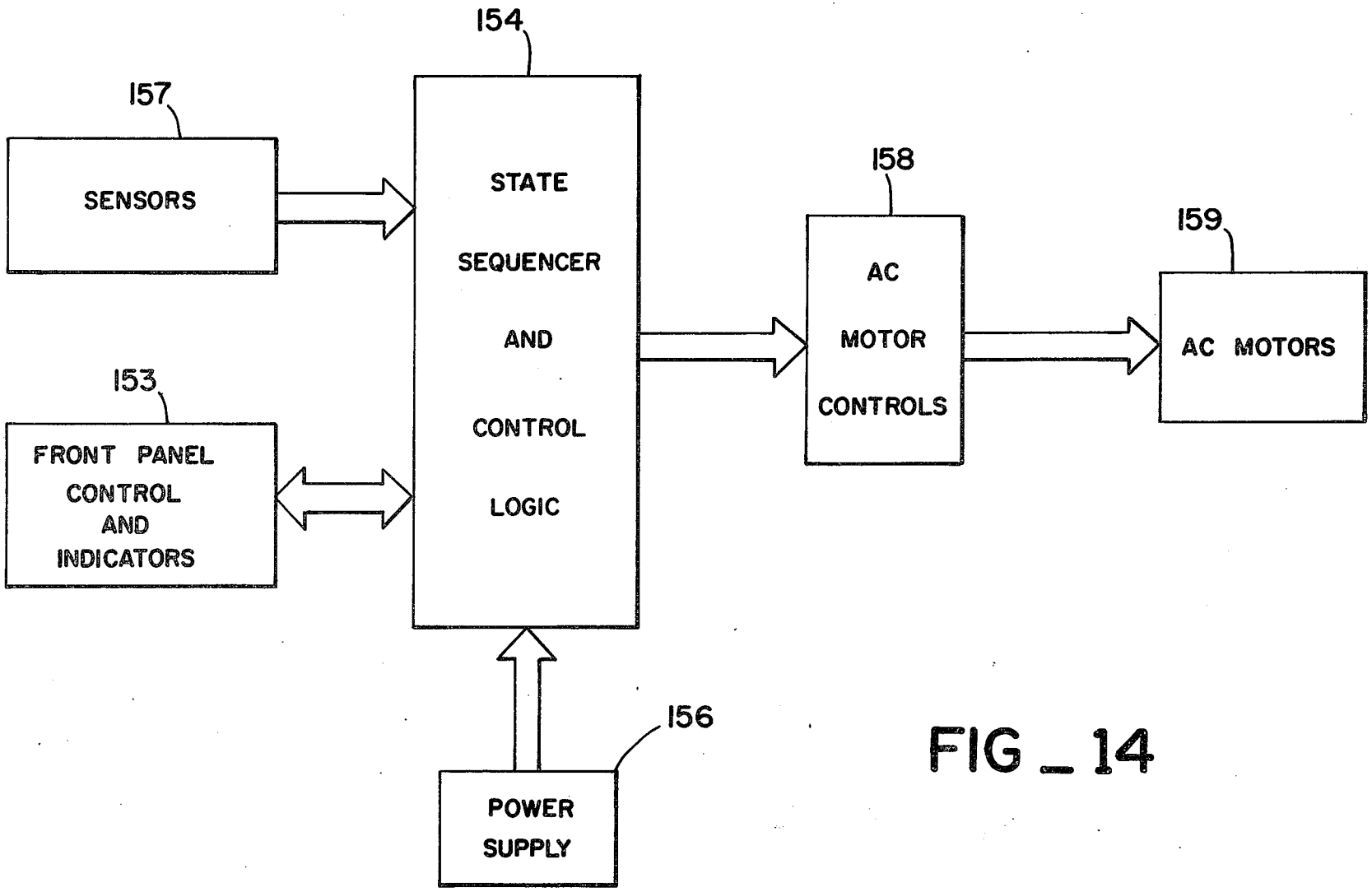
FIG. 14 is a block diagram depicting the interconnections of the sensors, controls, and motors of the machine of the present invention.

With reference to FIG. 14, the invention includes a state sequencer and control logic system 154 which controls the operation of the machine. The state sequencer is well known in the art of digital data control systems, and need not be explained in detail herein. The state sequencer and its associated control logic is controlled by a power supply 156. The control pushbuttons and the indicators of the front panel 153 are also connected to the state sequencer and control logic system 154 in a bidirectional fashion.

All of the sensors employed in the machine of the present invention, represented as block 157 in FIG. 14, are also connected to the state sequencer and control logic system. These sensors include the end of ribbon sensors 123 and 124, the mechanical end of ribbon sensors 126 and 127, the hole detector sensors 117 and 118, the photoelectric edge of ribbon sensors 148 and 149, the spool axial position sensors 151, the pressure roller motor assembly indicators 97, the other sensing systems which have not been described herein, such as the ink level sensor within the ink tank 47, and the like.

The output of the state sequencer and control logic system is used to operate the indicators on the front panel 153, and to operate the AC motor controls 158. The motor controls are in turn connected to all of the motors incorporated in the machine, as represented by block 159.

Figure 15:
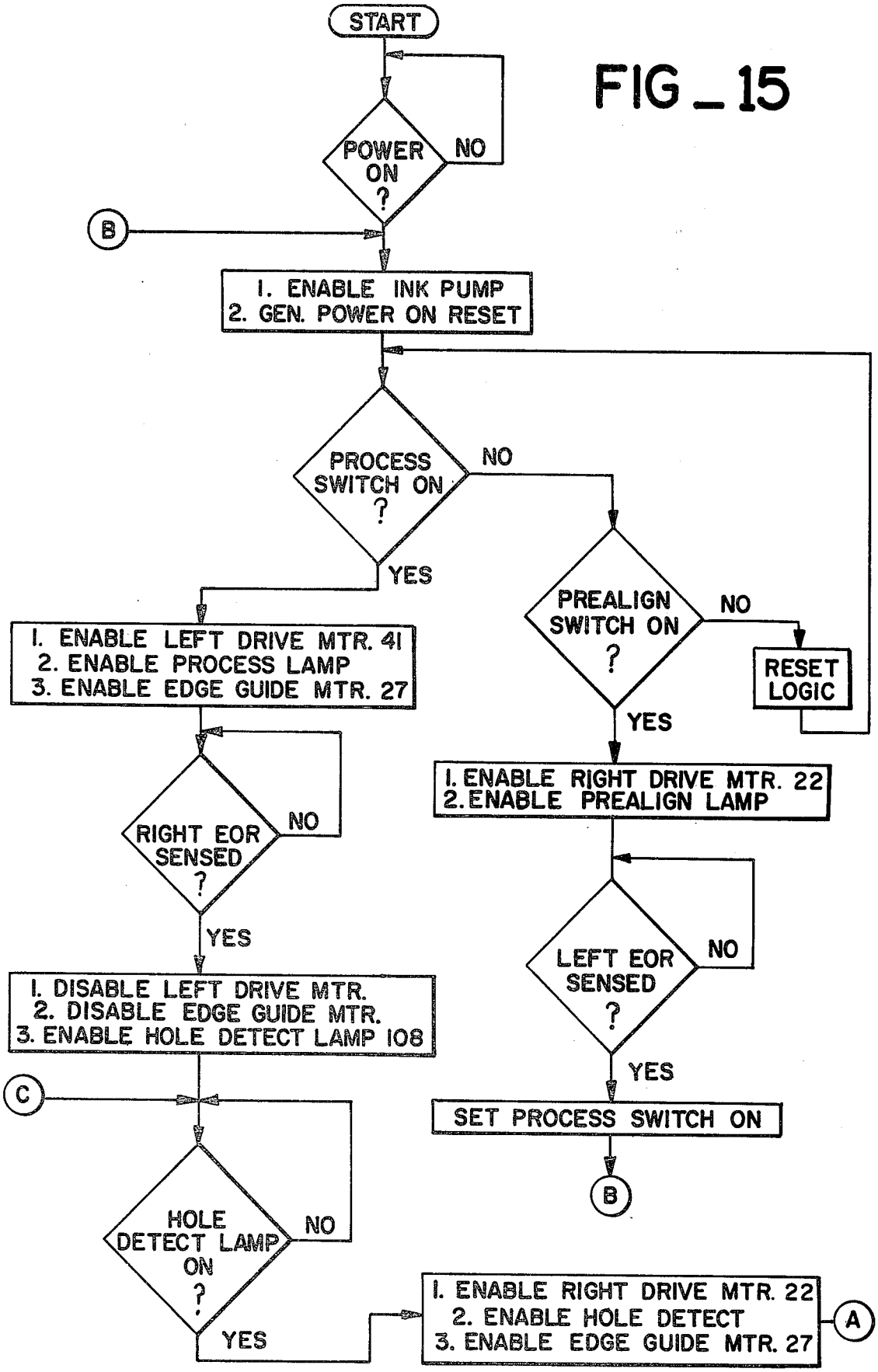
FIGS. 15 and 16 are a flow chart depicting the algorithm incorporated in the control logic of the machine of the present invention.
Figure 16:
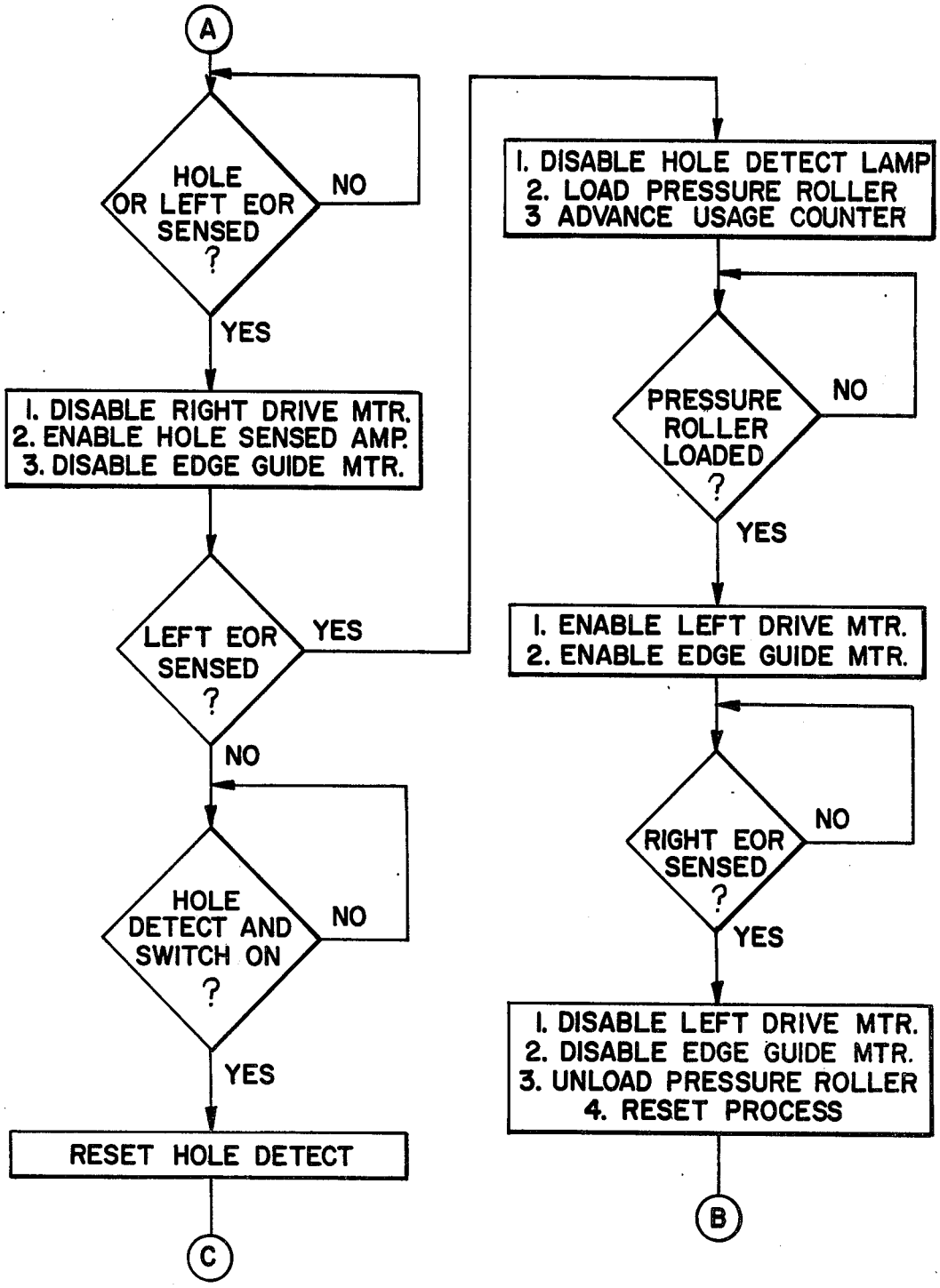

The algorithm embodied in the state sequencer and control logic system 154 is depicted in FIGS. 15 and 16. In describing this algorithm, the spool mechanism 160 is termed the right hand spool, and the drive motor 22 associated therewith is the right drive motor. Likewise, the spool mechanism 170 is referred to as the left hand mechanism, and its associated drive motor 41 is termed the left drive motor. Although the description of the operation of the machine will refer to processes which occur during travel of the printer ribbon in a particular direction, the machine may be controlled to perform the same processes in the reverse direction.

Generally speaking, the machine is operated by first placing the printer ribbon which is to be reinked on the spool mechanisms. The ribbon spool carrying the bulk of the printer ribbon is secured to the right hand spool mechanism 160, and the other ribbon spool is secured to the left hand spool mechanism 170. This is done with the upper frame assembly 66 in the raised position, as shown in phantom line in FIG. 2. The frame is manually lowered, and locked by means of the latch 107, and the printer ribbon inking sequence commences.

As shown in FIG. 15, the operator pushes the start button to begin the operation. If the power switch is off, the machine remains idle. If the power switch has been actuated, the ink pump is actuated to fill the ink tank to a predetermined level, and power is provided to the various systems of the machine. If the machine operator manually presses the process pushbutton, the left drive motor 41 is actuated, the process lamp indicator on the front panel is actuated, and the edge guide motor 27 is actuated. The machine thus transfers the printer ribbon from the right hand spool to the left hand spool, and the signals from the ribbon edge sensors 146 and 147 control the edge guide motor 27 so that the ribbon is wrapped on the left hand spool in uniform, parallel layers. This process continues until the right end of ribbon sensors, either sensor 124 or 127 is actuated. When this happens, the left drive motor is disabled, as is the edge guide motor 27, and the hole detector lamp 108 is illuminated.

When the signals from the sensors 117 and 118 indicate that the hole detector lamp 108 is indeed illuminated, the right drive motor 22, the hole detector logic system, and the edge guide motor 27 are actuated. Thus the ribbon is rewound on the right hand spool mechanism, with the hole detector scanning the ribbon for defects as the ribbon passes by. During this process, the edge guide motor 27 is controlled by the signals eminating from the sensors 151 which sense the axial position of the right hand spool and maintain it in a stationary axial position.

This process continues until a hole in the ribbon is sensed by the hole detecting logic, or the left end of the ribbon is detected by either of the sensors 123 or 126. In either event, the right drive motor is disabled, a hole sensed amplifier is enabled to actuate a panel light to indicate that event to the operator, and the edge guide motor 27 is disabled. Thus, the entire process is stopped. It should be noted that when the right drive motor is disabled, it is electrically braked to stop almost immediately, so that if a hole of significant size is present, it will be found by the operator to be directly adjacent to the hole detecting mechanism. The operator may then discern whether the hole is of sufficient size to render the printer ribbon useless.

If the event which stops the right drive process is indeed that the left end of the ribbon is detected, the hole detector lamp is disabled. This is due to the fact that the entire ribbon has passed by the hole detector with no holes being found, and the hole detector is no longer required. The pressure roller is then loaded onto the ribbon and the inking roller, so that the ribbon may be rewound and inked. Also, the usage counter which is associated with the machine and which indicates the number of times the machine has been used to actually ink a printer ribbon, is also advanced. After the pressure roller is loaded, as indicated by the sensor 97, the left drive motor is actuated once more, as is the edge guide motor 27. The ribbon is then rewound onto the left hand spool 170, the pressure roller causing it to impinge on the inking roller to pick up a fresh supply of ink therefrom. When the right end of the ribbon is sensed by the sensors 124 or 127, the left drive motor is deactuated, as is the edge guide motor 27. The pressure roller is unloaded from the ribbon and inking roller, and the system returns to point B on the algorithm, as shown in FIG. 15.

If the event which halts the hole scanning process is that a hole in the ribbon is detected, a reset button on the control panel is illuminated. This button apprises the operator of the fact that the machine has stopped because a hole in the ribbon has been detected. It is as this point that the operator may visually inspect the ribbon to see if the hole is of significant size. If the hole is too large, the ribbon is removed from the machine and discarded. If the hole is sufficient small not to adversely affect the print quality of the ribbon, the operator may press the reset button and the algorithm will return to point C thereof, as shown in FIG. 15. The hole scanning sequence then continues as described previously.

The algorithm of the present invention is also adapted to accommodate printer ribbons which are significantly skewed or badly wrapped on their spools. The control panel is provided with a prealignment pushbutton which permits the machine to transfer the printer ribbon from the left spool to the right spool to rewrap the ribbon in a more orderly manner on the right spool. If the process pushbutton switch is not actuated, the operator may select the prealignment pushbutton switch to actuate the right drive motor and the lamp which illuminates the prealignment pushbutton. The ribbon is thus wound onto the right hand spool until the left end of ribbon is sensed. When that occurs, the algorithm automatically sets the process pushbutton switch on, and the algorithm proceeds directly to point B. The hole scanning procedure and the inking procedure then proceed as described in the foregoing.

I claim:

1. An apparatus for inking a printer ribbon extending between and wrapped about at least one of a pair of spools, comprising a base member; a pair of spool mechanisms secured to said base member in spaced apart relationship for supporting said spools; said spool mechanism including motor means for rotating said spools and transferring said printer ribbon therebetween; inking means, disposed between said spool mechanisms, for selectively inking said printer ribbon translating thereby; hole detector means, secured to said base member, for detecting holes in said printer ribbon, including a substantially planar transparent member having one edge adjacent to said printer ribbon and a parabolic edge extending from said one edge in convex fashion, said parabolic edge having an optical focus disposed proximate to a medial portion of said one edge, the planar surfaces and said parabolic edge being coated for total internal reflection, photoelectric pickup means disposed on said one edge proximate to said focus of said parabolic edge, means for illuminating said printer ribbon on the side thereof opposite said one edge, including a fixed light source extending the width of said printer ribbon opposite said one edge and directed thereto, and means responsive to said hole detector means, including electrical brake means for stopping said motor means with a detected hole adjacent to said hole detector means.

2. An apparatus for inking a printer ribbon extending between and wrapped about at least one of a pair of spools, comprising a base member; a pair of spool mechanisms secured to said base member in spaced apart relationship for supporting said spools; said spool mechanisms including motor means for rotating said spools and transferring said printer ribbon therebetween; inking means, disposed between said spool mechanisms, for selectively inking said printer ribbon translating thereby; means for sensing complete unwinding of said printer ribbon from at least one of said spools, including a magnetic flux conducting member secured to said printer ribbon adjacent one end thereof, electromagnetic coil means adjacent said at least one spool for directing an electromagnetic field toward said printer ribbon, and means for sensing a change in induction of said electromagnetic coil means as said magnetic flux conducting member passes thereby, said means for sensing complete unwinding of said printer ribbon being operatively connected to said motor means.

3. An apparatus for inking a printer ribbon extending between and wrapped about at least one of a pair of spools, comprising a base member; a pair of spool mechanisms secured to said base member in spaced apart relationship for supporting said spools; said spool mechanisms including motor means for rotating said spools and transferring said printer ribbon therebetween; inking means, disposed between said spool mechanisms, for selectively inking said printer ribbon translating thereby; said printer ribbon extending tangentially to each of said spools and forming an acute angle with the surface thereof, said angle abruptly increasing to an oblique angle as the end portion of said printer ribbon is unwound from its tangential relationship with said spools, means for sensing complete unwinding of said printer ribbon from at least one of said spools, including switch means having a leaf actuator spaced from said spool and extending into the vertex of said acute angle and positioned to be actuated as said angle increases to an oblique angle, said switch means operatively connected to said motor means.

* * * * *